US008646137B2

(12) United States Patent
Andina

(10) Patent No.: US 8,646,137 B2
(45) Date of Patent: Feb. 11, 2014

(54) BOTTLE OPENING DEVICE FOR CUTTING THE CAPSULE COVERING THE NECK OF THE BOTTLE

(75) Inventor: Diego Andina, Cellatica (IT)

(73) Assignee: Ghidini Cipriano S.r.l., Gussago (IT)

( * ) Notice: Subject to any disclaimer, the term of this patent is extended or adjusted under 35 U.S.C. 154(b) by 84 days.

(21) Appl. No.: 13/154,937

(22) Filed: Jun. 7, 2011

(65) Prior Publication Data

US 2011/0308357 A1 Dec. 22, 2011

(30) Foreign Application Priority Data

Jun. 17, 2010 (EP) ..... 10425206

(51) Int. Cl.

| | |
|---|---|
| ***B67B 7/04*** | (2006.01) |
| ***B67B 7/62*** | (2006.01) |
| ***B67B 7/18*** | (2006.01) |
| ***B67B 7/00*** | (2006.01) |

(52) U.S. Cl.
USPC ..... 7/156; 81/3.48; 81/3.37; 81/3.29; 7/154; 7/155

(58) Field of Classification Search
USPC ..... 81/3.48, 3.29, 3.37, 3.55–3.57, 3.25, 81/3.32, 3.09, 3.4, 3.07, 3.45, 3.43; 7/151, 7/154–156
See application file for complete search history.

(56) References Cited

U.S. PATENT DOCUMENTS

| | | | | |
|---|---|---|---|---|
| 1,990,289 | A | 2/1935 | Krueger | |
| 4,399,720 | A * | 8/1983 | Cuppett | 81/3.37 |
| 2005/0050643 | A1 * | 3/2005 | Hefti et al. | 7/156 |
| 2008/0022810 | A1 | 1/2008 | Panetti | |

FOREIGN PATENT DOCUMENTS

| | | |
|---|---|---|
| GB | 2 322 622 A | 9/1998 |
| IT | 1 161 607 | 3/1987 |

OTHER PUBLICATIONS

Extended European Search Report dated Nov. 17, 2010.

* cited by examiner

*Primary Examiner* — Monica Carter
*Assistant Examiner* — Danny Hong
(74) *Attorney, Agent, or Firm* — Kilyk & Bowersox, P.L.L.C.

(57) ABSTRACT

Bottle opening device, particularly for cutting the capsule covering the stopper of a bottle, comprising a shaft provided with a threaded portion and, above, with a widened portion that has a hole in it.
The widened portion comprises two plates which are provided internally with mutually aligned openings for the transversal insertion of a stopper.
The plates are spaced apart so as to define a space for accommodating a supporting body which is provided with at least one cutting element.

20 Claims, 5 Drawing Sheets

BOTTLE OPENING DEVICE FOR CUTTING THE CAPSULE COVERING THE NECK OF THE BOTTLE

The present invention relates to a bottle opening device, particularly for cutting the capsule covering the stopper of a bottle.

BACKGROUND ART

Known devices for opening bottles are divided into two principal categories: corkscrews (also known as cork pullers), in which the device is used to extract a stopper made of corkwood or plastics from the neck of the bottle, in general a wine bottle; and bottle cap openers (also known simply as bottle openers), in which the device is used for opening bottles closed with crown caps or capsules.

Known corkscrews are comprised of a self-tapping screw, called a worm, which is screwed into the stopper and to which is subsequently applied an axial traction force that is sufficient to defeat the friction that keeps the stopper in place, so extracting it. In some models of corkscrews the traction force is exerted directly by the user, while in others it is amplified by means of levers cooperating with a rack, and in others it is produced by exploiting the Archimedes screw principle. Generally the corkscrew is made of steel or of zinc alloys with, occasionally, some portions made of wood, such as the handle in manual models.

The bottle cap opener is usually comprised of a metal bar that has an opening or a slot into which the cap is inserted in such a way that one side of the slot rests on top of the cap, acting as a fulcrum, and the other side acts on the edge of the cap, lifting it. Bottle cap openers are made in countless shapes and finishes.

The term "bottle opener" is usually used to indicate devices that combine different opening systems, including a bottle cap opener and a corkscrew. In particular, devices are known that are provided with a threaded portion, acting as a corkscrew, and a widened portion provided with a slot, acting as a bottle cap opener.

Therefore, for clarity, the term "bottle opening device" is used herein to indicate a device for opening bottles that is provided both with a corkscrew, and more generically with a threaded portion that is adapted to be screwed into a stopper, and also with a bottle cap opener, and more generally with a slot inside which the cap to be lifted and removed is inserted.

Bottles, in particular bottles made of glass, have a thin capsule made of a flexible material wrapped around the neck to cover the stopper.

Usually, to remove this capsule, small knives or toothed blades are used to make a cut around such capsule in order to remove it and gain access to the stopper.

Nowadays, devices for opening bottles are known that are provided with means that are especially designed to perform the cut in the capsule.

However, these known devices provided with capsule cutting means are not entirely devoid of problems and drawbacks.

In particular, in the known devices the cutting portions are not suitably covered but on the contrary they are located in portions of the device that come into contact with the user's hand, so exposing the user to the risk of cuts and wounds.

Moreover, in known devices the cutting portion is incorporated in a fixed and permanent manner to the device, and this is particularly disadvantageous because, if the cutting portion is damaged, the entire device must be discarded.

Moreover, the capsule cutting means incorporated in known devices are not capable of adapting easily to different sizes of bottle necks

SUMMARY OF THE INVENTION

The aim of the present invention is to solve the aforementioned problems, by removing the drawbacks of the cited prior art devices.

Within this aim, an object of the invention is to provide a bottle opening device that functions as a corkscrew, as a bottle cap opener and also as a capsule cutter.

A further object of the invention is to provide a bottle opening device that performs a well-defined and precise cut of the capsule.

Another object of the invention is to provide a bottle opening device that is easy and safe to use.

Another object of the present invention is to provide a bottle opening device that adapts easily to cutting the capsules on bottle necks of different sizes.

A still further object of the present invention is to provide a bottle opening device that has reduced encumbrance.

Another object of the present invention is to provide a bottle opening device that optimally combines, both from the functional point of view and also from the point of view of spatial encumbrance, the corkscrew function with the bottle cap opener function.

Another object of the present invention is to provide a bottle opening device that is highly reliable, easy to implement and at low cost.

This aim, as well as these and other objects which will become better apparent hereinafter, are achieved by a bottle opening device, particularly for cutting the capsule covering the neck of a bottle, comprising a shaft provided with a threaded portion and, above, with a widened portion that has a hole in it, characterised in that said widened portion comprises two plates which are provided internally with mutually aligned openings for the transversal insertion of a stopper, said plates being mutually spaced apart so as to define a space for accommodating a supporting body that is provided with at least one cutting element.

BRIEF DESCRIPTION OF THE DRAWINGS

Further characteristics and advantages of the present invention will become better apparent from the description of a preferred, but not exclusive, embodiment of the bottle opening device according to the invention, illustrated, by way of a non-limiting example, in the accompanying drawings wherein.

DESCRIPTION OF THE PREFERRED EMBODIMENTS

Figure 1:
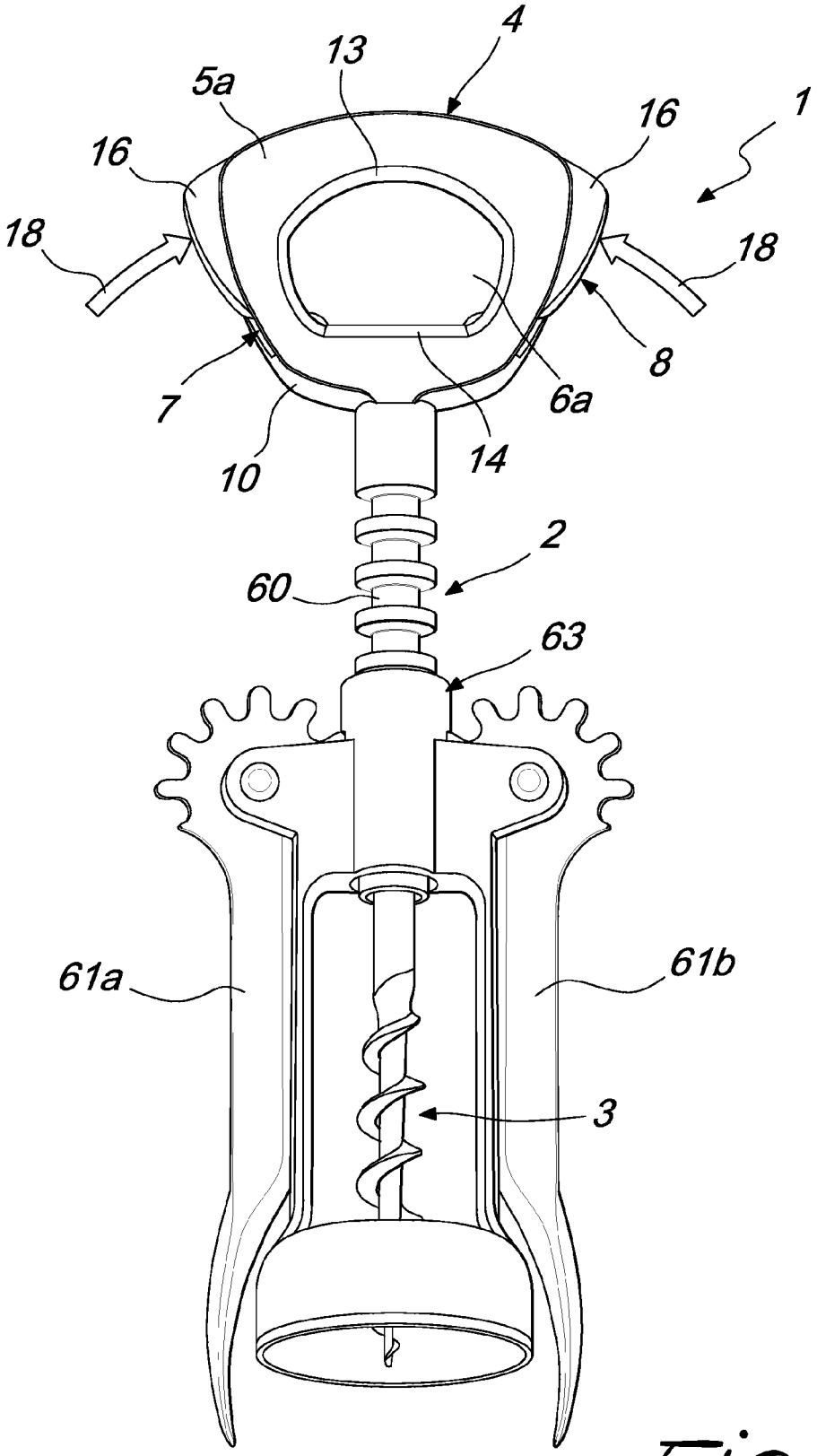
FIG. 1 is a perspective view of the device according to the invention.
Figure 2:
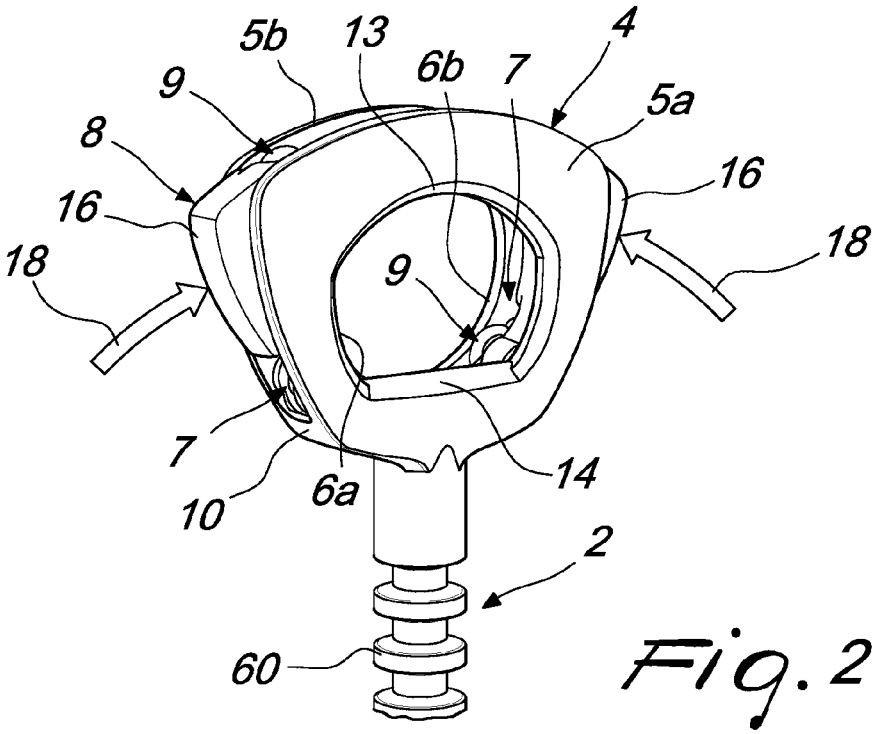
FIG. 2 is a perspective view of a detail of a bottle opening device according to the invention.
Figure 7:
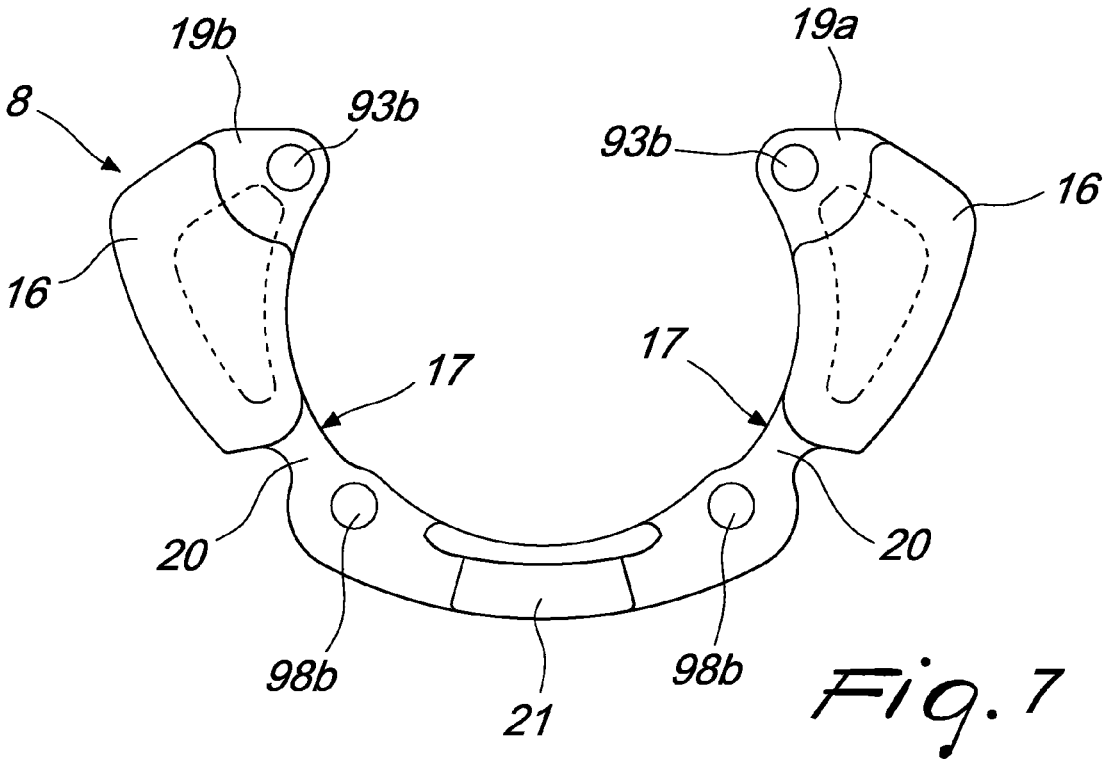
FIG. 7 is a front elevation view of a supporting body.

With reference to the figures, the bottle opening device according to the invention, indicated generally with the reference numeral 1, comprises a shaft 2 provided with a threaded portion 3 that is adapted to be screwed into the stopper of the bottle.

Above the threaded portion 3, the shaft 2 comprises a widened portion 4 that has a hole in it and which comprises two plates 5*a* and 5*b*.

The plates 5*a* and 5*b* are provided internally and centrally with openings, respectively 6*a* and 6*b*, that are mutually aligned for the transversal insertion of the stopper of a bottle.

Preferably, the shaft 2 and the widened portion 4 are made in a single piece.

The presence of the threaded portion 3 enables the device 1 to act as a corkscrew while the presence of the openings 6*a* and 6*b* enables the device 1 to act as a bottle cap opener.

More specifically, the plates 5*a* and 5*b* can be mutually parallel or mutually inclined internally or externally. Alternatively, only one of the two plates 5*a* and 5*b* can be inclined while the other remains substantially comprised on the same plane as the shaft 2.

Preferably, the plates 5*a* and 5*b* have an identical outer profile while the openings 6*a* and 6*b* have different profiles from each other. In more detail, the opening 6*b* has a profile that is substantially circular and the opening 6*a* has a shape that is substantially defined by a semicircular profile 13 with, at its base, a rectilinear profile 14 that has an inclined thickness.

The circular opening 6*b*, being larger in size, facilitates the transversal insertion of the stopper while the rectilinear profile 14 of the opening 6*a* allows its stable fitting onto the circular base of the cap to be lifted. Therefore, to use the device 1 as a bottle cap opener, the upper area of the circular opening 6*b* rests on the cap, acting as a fulcrum, while the rectilinear profile 14 of the opening 6*a* acts on the circular edge of the cap, lifting it.

In the bottle opening device 1, the plates 5*a* and 5*b* are spaced apart so as to define a space 7 for accommodating a supporting body 8 that supports at least one cutting element 9.

Advantageously, the plates 5*a* and 5*b* can be made as a single body, comprising a connection base 10 that is common to both of the plates and which can be associated with the shaft 2 or which can be integral with the shaft 2.

The supporting body 8 is fixed to the shaft 2 by means of a first pin 11 which, by passing through a first punching 12*a* defined on said supporting body 8, is inserted into a first hole 12*b* that is defined on the base 10 or directly on the shaft 2.

When no cap is inserted between the openings 6*a* and 6*b*, the device 1 assumes a rest configuration, in which the cutting element 9 is completely hidden behind the profiles of the opening 6*a* or also of the opening 6*b*.

But when a cap is transversally inserted between the openings 6*a* and 6*b*, the device 1 assumes an operational configuration, in which the cutting element 9 protrudes from the profiles of the opening 6*a* or also of the opening 6*b*.

In more detail, in the rest configuration, the cutting element 9 is covered by the two plates 5*a* and 5*b* without entering inside the volume that is defined by the through hole 15 which is defined by the alignment of the two openings 6*a* and 6*b*. In the operational configuration, the cutting element 9 extends into the volume that is defined by the through hole 15 and it comes into contact with the capsule to be cut.

The supporting body 8 comprises at least one protruding portion 16, which protrudes laterally from the outer lateral profile of the plates 5*a* and 5*b*. Preferably, the supporting body comprises two protruding portions 16 that protrude on the two opposite sides of the plates 5*a* and 5*b*.

Each protruding portion 16 is connected with at least one elastically flexible portion 17.

To pass from the rest configuration to the operational configuration, the device 1 comprises activation means upon which the user acts.

Advantageously, the activation means are defined by the protruding portions 16.

More specifically, applying a pushing action 18 to the protruding portions 16 causes their flexion, which is directed toward the through hole 15.

This flexion movement of the protruding portions 16 is possible thanks to their connection with the elastically flexible portion 17.

Following the flexion of the protruding portion or portions 16, the cutting elements 9 associated with the supporting body 8 are pushed towards the centre of the through hole 15 in such a way as to make them protrude inside the plane defined by the opening 6*a*.

In this way, the cutting elements 9 come into contact with the capsule to be cut. By keeping a pressure applied to the protruding portion or portions 16 and by performing a rotation of the bottle with respect to the device 1, the cutting of the capsule covering the stopper is achieved.

In general, the supporting body 8 can have different shapes and sizes which, however, must be such as to permit the accommodation of the body 8 inside the accommodation space 7 defined between the two plates 5*a* and 5*b*.

Preferably, the supporting body 8 can have substantially the shape of an arc of circumference in which the protruding portions 16*a* and 16*b* are defined respectively at the ends 19*a* and 19*b* of the arc.

The protruding portions 16*a* and 16*b* have a greater thickness than that of the remaining portions of the supporting body 8, but their thickness must not exceed the distance between the plates 5*a* and 5*b*, i.e. the thickness of the accommodation space 7.

For a supporting body 8 with an arc shape, the elastically flexible portions 17 are defined at the thin and curved branches 20 located at the sides of the central portion 21 of the arc. The thin and curved configuration of the branches 20 allow the protruding portions 16 to be bent so as to cause their mutual approach or retreat.

The cutting element 9 can comprise a disc 91 that is provided with a sharpened edge 92. A second pin 94 pass through a second punching 93*a* defined centrally on the disc 91 and is then inserted into second holes 93*b* which are defined on the supporting body 8. Advantageously, the disc 91 can be fixed to the supporting body 8 so as to permit its rotation about the second pin 94. In more detail, a disc 91 can be associated with each of the ends 19 of the supporting body 8 at the recesses 23 of the protruding portions 16.

Figure 3:
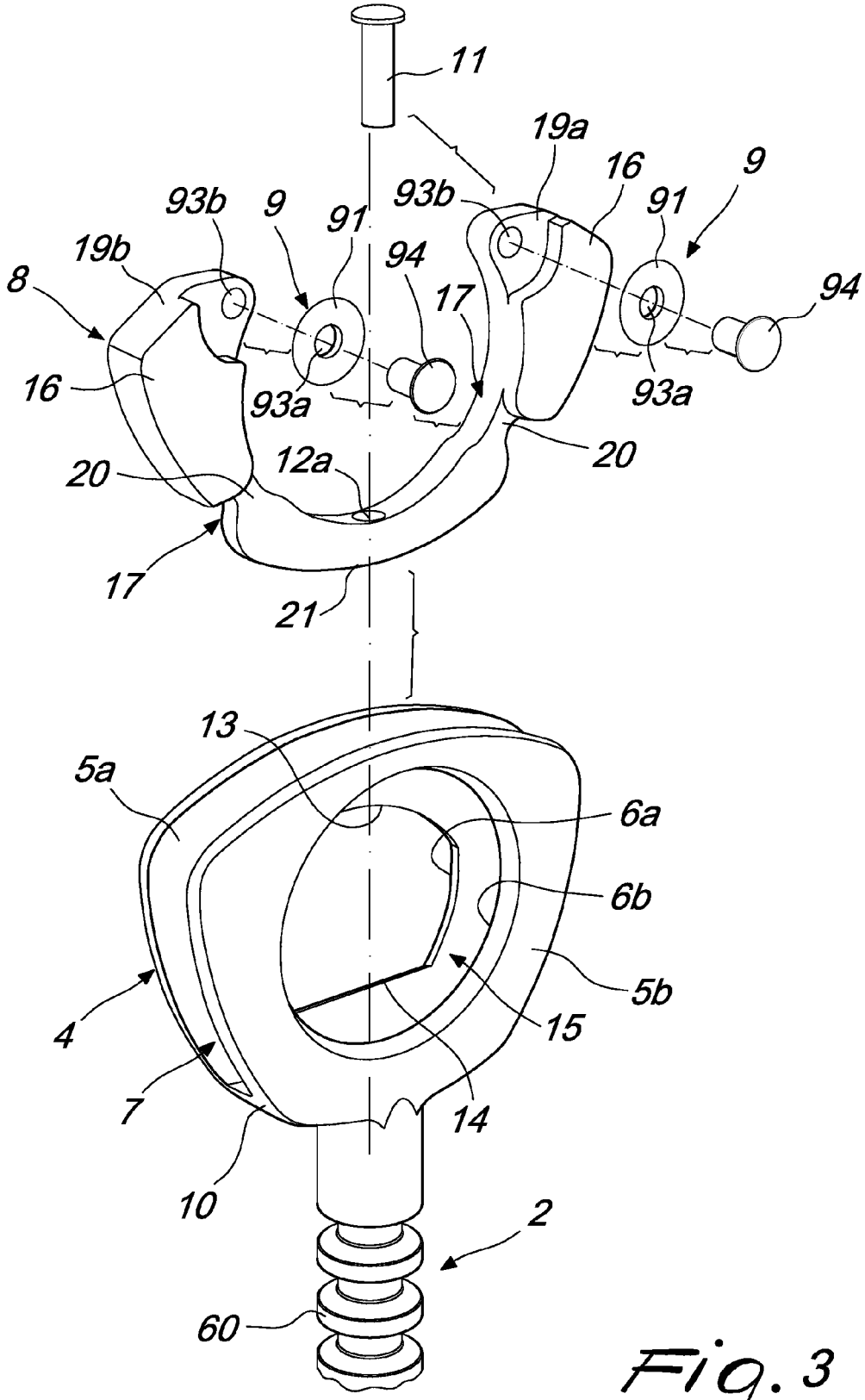
FIG. 3 is an exploded view of a first preferred, but not exclusive, embodiment of the bottle opening device according to the invention.

In a first preferred embodiment, shown in FIG. 3, the cutting elements 9 of the device 1 comprise two discs 91, located respectively at the ends 19*a* and 19*b* of the supporting body 8.

Moreover, the cutting element 9 can comprise an arced arm 95 that is provided at its ends 96*a* and 96*b* with sharpened profiles, respectively 97*a* and 97*b*. Third pins 99 pass through third punchings 98*a*, positioned at the ends 96*a* and 96*b*, and are then inserted into third holes 98*b* which are defined in the central portion 21 of the supporting body 8.

Figure 4:
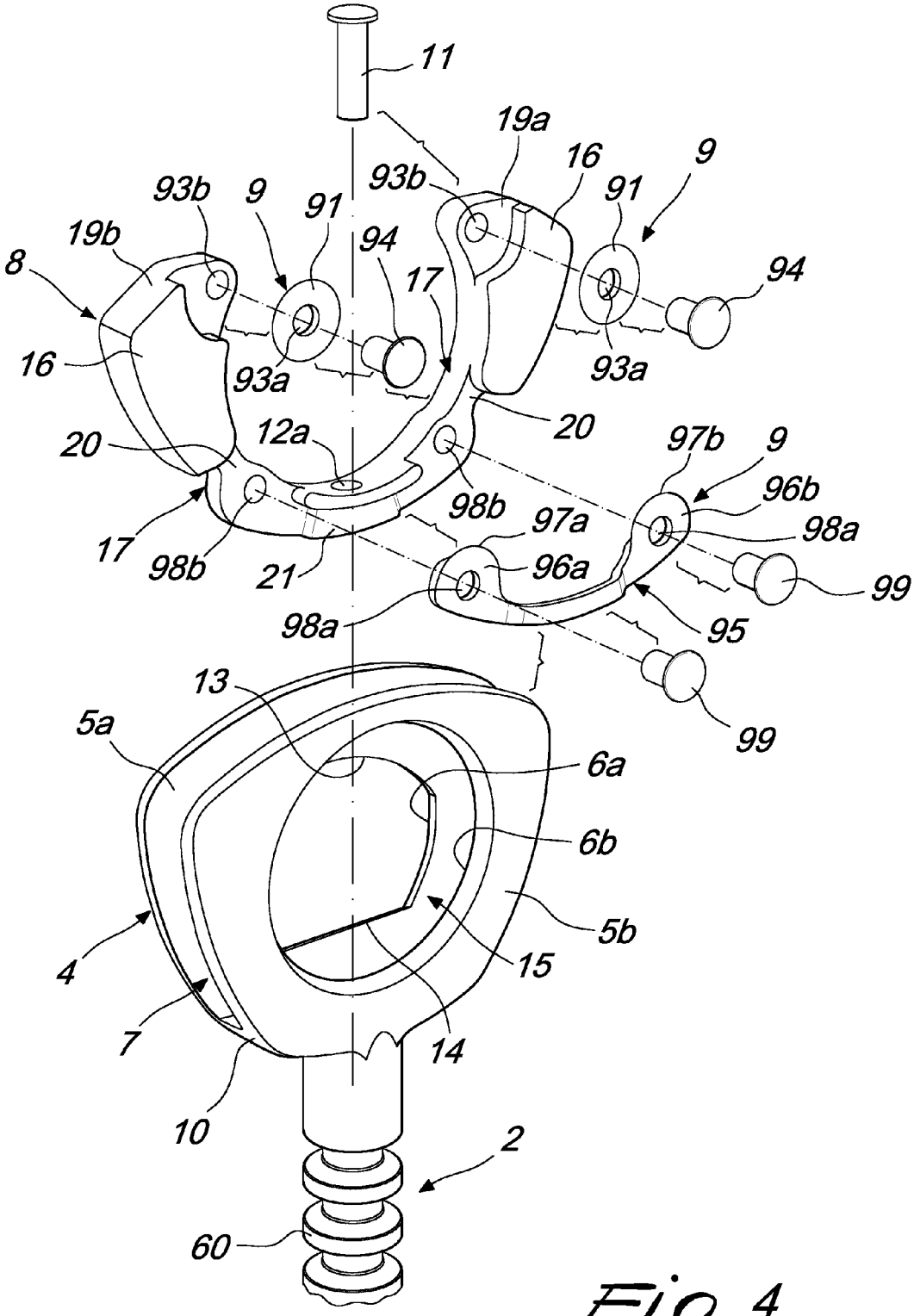
FIG. 4 is an exploded view of a second preferred, but not exclusive, embodiment of the bottle opening device according to the invention.
Figure 5:
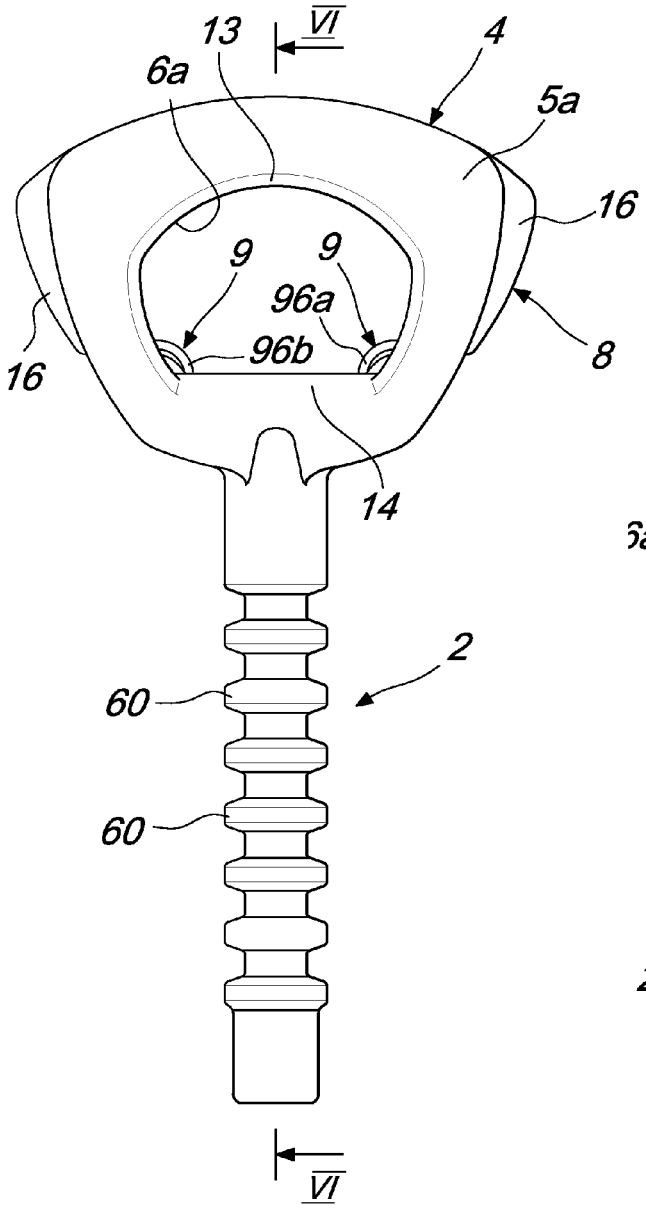
FIG. 5 is a front elevation view of the second embodiment of the bottle opening device according to the invention.
Figure 6:
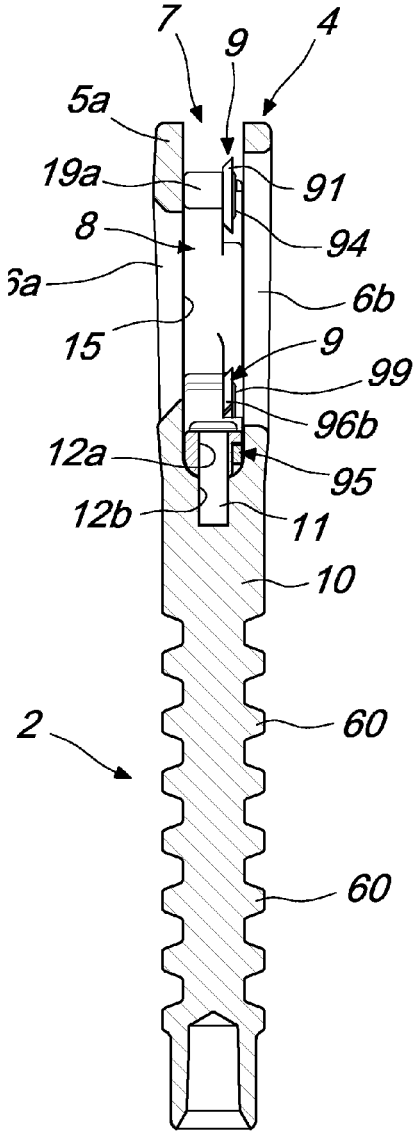
FIG. 6 is a side sectional view, taken along the line VI-VI, of the second embodiment of the bottle opening device according to the invention.

In a second preferred embodiment, shown in FIGS. 4 to 6, the cutting elements 9 of the device 1 comprise in addition to the two discs 91, located respectively at the ends 19*a* and 19*b* of the supporting body 8, also an arced arm 95 which is associated with the central portion 21 of the supporting body 8.

Advantageously, the device 1 can comprise a system, known per se, to facilitate the extraction of the stopper from the bottle. Specifically, such system comprises a shaft 2 provided with a rack 60 which cooperates with a pair of levers 61*a* and 61*b* which are mounted laterally on a supporting structure 63, which is provided with a perforated cylinder inside which the shaft 2 is inserted.

The user, by acting on the widened portion 4, makes the shaft 2 rotate inside the supporting structure 63 thereby screwing the threaded portion 3 into the stopper and, at the same time, causing the rotation of the levers 61*a* and 61*b* upwards and outwards. Subsequently, by pushing the levers 61*a* and 61*b* downwards a force is applied that allows the extraction of the stopper.

Advantageously the shaft 2 and the widened portion 4 are made for example of chrome zinc alloy. The supporting body 8 is made for example of plastics. The cutting elements are made for example of tempered steel. The first pins 11, the second pins 94 and the third pins 99 are made for example of steel.

In practice it has been found that the device according to the invention fully achieves the aim and objects in that the bottle opening device makes it possible to perform the cut in the capsule that covers the stopper easily, quickly, practically and safely.

In particular, the fact that the cutting element is covered by the plates when in the rest configuration prevents any contact, even accidental, between said cutting element and the user. Moreover, this feature makes it possible to add the capsule cutting functionality to the device without having to excessively modify the aesthetics and encumbrance of the device itself.

Moreover, the fact that the cutting element protrudes into the openings only when the device is in the operational configuration increases the level of safety of the device, since to activate such configuration the user must press on the protruding portions with his/her fingers, thus making contact between the cutting element and other parts of the body highly unlikely.

Moreover, the fact that pressing on the protruding portions of the supporting body brings the cutting element into contact with the capsule to be cut offers greater ease of adaptation to bottle necks of different diameters. In fact, increasing or decreasing the pressure on the protruding portions causes the approach of the cutting element towards the neck of the bottle or its retreat therefrom.

Moreover, the fact that the cutting element is associated with the supporting body, which can in turn be associated non-permanently with the shaft and with the widened portion, allows the substitution of said supporting body and, in particular, it allows the substitution of the cutting element. This is particularly advantageous if the cutting profile is worn with use.

Moreover, the presence of a plurality of cutting elements such as, for example, two discs and an arced arm make it possible to achieve a cut that is better defined and of better quality, as well as speeding up the entire cutting operation.

Finally, the fact that the cutting elements have profiles that are substantially curved makes it possible to easily slide them on the smoothened surface of the neck of the bottle.

Although the device according to the invention has been conceived specifically for bottle opening devices that have both a corkscrew function and also a bottle cap opener function, it can in any case be used, more generally, for devices that act only as corkscrews or only as bottle cap openers.

The device, thus conceived, is susceptible of numerous modifications and variations, all of which are within the scope of the inventive concept. Moreover, all the details may be substituted by other, technically equivalent elements.

In practice, the materials employed, as well as the dimensions, may be any according to requirements and to the state of the art.

The disclosures in European Patent Application No. 10425206 from which this application claims priority are incorporated herein by reference.

What is claimed is:

1. Bottle opening device, particularly for cutting the capsule covering the neck of the bottle, comprising a shaft provided with a threaded portion and, above, with a widened portion that has a through-hole therein, wherein said widened portion comprises two plates which are provided internally with mutually aligned openings for the transversal insertion of a stopper, said plates being spaced apart so as to define a space for accommodating a supporting body that is provided with at least one cutting element, wherein said at least one cutting element having a hidden rest configuration and a protruding operational configuration with control thereof by a means of activation.

2. Device according to claim 1, wherein in said rest configuration said at least one cutting element is covered by said two plates and completely hidden behind profiles of said openings, and in the operational configuration said at least one cutting element protrudes towards said through-hole and outside the profiles of said openings.

3. Device according to claim 2, wherein said means of activation causing passing of the device from said rest configuration to said operational configuration.

4. Device according to claim 1, wherein said supporting body is removably connected with said shaft, said at least one cutting element being removably associable with said supporting body.

5. Device according to claim 1, wherein said supporting body comprises at least one portion that protrudes externally from said plates and which is connected with at least one elastically flexible portion, wherein said at least one portion that protrudes is pushable toward said through-hole wherein said at least one cutting element is pushable to protrude inside the mutually aligned openings.

6. Device according to claim 1, wherein said supporting body substantially has the shape of an arc of circumference.

7. Device according to claim 5, wherein said protruding portions are defined at each end of said arc.

8. Device according to claim 1, wherein said at least one cutting element comprises a disc, with a sharpened edge, that rotates about a pin that is associable with said supporting body.

9. Device according to claim 1, wherein said at least one cutting element comprises an arced arm provided with sharpened curved profiles at its ends.

10. Device according to claim 8, further comprising two of said discs associated with the ends of said supporting body.

11. Device according to claim 1, further comprising an arced arm that is associated with a central portion of said supporting body.

12. Device according to claim 1, wherein said shaft comprises a rack that cooperates with a pair of levers which are mounted laterally on a supporting structure for said shaft, said shaft being rotatable with respect to said structure.

13. Device according to claim 1, wherein at least one of said openings of said plates is defined by a semicircular profile with, at its base, a rectilinear profile that is adapted to provide a stable fitting with the circular base of the cap to be lifted.

14. Device according to claim 1, wherein said supporting body is made of plastics.

15. Bottle opening device, particularly for cutting the capsule covering the neck of the bottle, comprising a shaft provided with a threaded portion and, above, with a widened portion that has a through-hole therein, wherein said widened portion comprises two plates which are provided internally with mutually aligned openings for the transversal insertion of a stopper, said plates being spaced apart so as to define a space for accommodating a supporting body that is provided with at least one cutting element, and comprising a rest configuration with said at least one cutting element completely hidden behind a profile of at least one of said openings, and an operational configuration with said at least one cutting element protruding outside the profile of at least one of said openings, with control of said at least one cutting element to pass from said rest configuration to said operational configuration by a means of activation.

16. Bottle opening device, particularly for cutting the capsule covering the neck of the bottle, comprising a shaft provided with a threaded portion and, above, with a widened portion that has a through-hole therein, wherein said widened portion comprises two plates which are provided internally with mutually aligned openings for the transversal insertion of a stopper, said plates being spaced apart so as to define a space for accommodating a supporting body that is provided with at least one cutting element, and comprising a rest configuration with said at least one cutting element completely hidden behind a profile of at least one of said openings, and an operational configuration with said at least one cutting element extending into a volume that is defined by the through-hole, with control of said at least one cutting element to pass from said rest configuration to said operational configuration by a means of activation.

17. Device according to claim 15, wherein said supporting body comprises at least one protruding portion that protrudes externally from said plates and which is connected with at least one elastically flexible portion, wherein the at least one protruding portion is capable of being pushed to cause flexion thereof, which is directed toward the through-hole to make the at least one cutting element protrude inside at least one of said openings to be capable to come into contact with a capsule to be cut.

18. Device according to claim 1, wherein the mutually aligned openings defining the through-hole.

19. Device according to claim 15, wherein the mutually aligned openings defining the through-hole.

20. Device according to claim 16, wherein the mutually aligned openings defining the through-hole.

* * * * *